US011173084B2

(12) United States Patent
Dowding

(10) Patent No.: US 11,173,084 B2
(45) Date of Patent: Nov. 16, 2021

(54) SIT-TO-STAND WHEELCHAIR

(71) Applicant: Dowding Tool Products LLC, Springport, MI (US)

(72) Inventor: Maurice H. Dowding, Springport, MI (US)

(73) Assignee: Dowding Tool Products LLC, Springport, MI (US)

( * ) Notice: Subject to any disclaimer, the term of this patent is extended or adjusted under 35 U.S.C. 154(b) by 360 days.

(21) Appl. No.: 16/350,153

(22) Filed: Oct. 4, 2018

(65) Prior Publication Data

US 2019/0133856 A1 May 9, 2019

Related U.S. Application Data

(60) Provisional application No. 62/707,596, filed on Nov. 9, 2017.

(51) Int. Cl.

| | |
|---|---|
| ***A61G 5/14*** | (2006.01) |
| ***A61G 5/10*** | (2006.01) |
| ***B24B 23/00*** | (2006.01) |
| ***B24B 23/02*** | (2006.01) |
| *A61G 7/10* | (2006.01) |
| *A61G 5/12* | (2006.01) |

(52) U.S. Cl.

CPC ..... *A61G 5/14* (2013.01); *A61G 5/104* (2013.01); *A61G 5/1059* (2013.01); *B24B 23/005* (2013.01); *B24B 23/02* (2013.01); *A61G 5/128* (2016.11); *A61G 7/1017* (2013.01)

(58) Field of Classification Search

CPC ..... A61G 5/14; A61G 5/104; A61G 5/128; A61G 5/1059; A61G 7/1017; B24B 23/02; B24B 23/005

USPC ..... 280/250.1

See application file for complete search history.

(56) References Cited

U.S. PATENT DOCUMENTS

| | | | | |
|---|---|---|---|---|
| 3,405,954 | A | 10/1968 | Wolfe | |
| 3,807,795 | A | 4/1974 | Weant | |
| 3,907,051 | A | 9/1975 | Weant | |
| 4,054,319 | A | 10/1977 | Fogg, Jr. | |
| 4,809,804 | A | 3/1989 | Houston | |
| 4,948,156 | A | 8/1990 | Fortsner | |
| 5,513,867 | A * | 5/1996 | Bloswick ..... | A61G 5/14 280/250.1 |
| 5,772,226 | A | 6/1998 | Bobichon | |
| 6,533,304 | B2 | 3/2003 | Lizama-Trpmcpsp | |
| 6,565,112 | B2 | 5/2003 | Hanson | |
| 6,641,354 | B1 | 11/2003 | Lubrano | |
| 6,976,698 | B2 | 12/2005 | Kuiken | |

(Continued)

*Primary Examiner* — Minnah L Seoh
*Assistant Examiner* — Felicia L. Brittman
(74) *Attorney, Agent, or Firm* — Honigman LLP; Brett A. Krueger

(57) ABSTRACT

This invention comprises a low cost, high strength sit-to-stand wheel chair assembly. It is comprised of a base with an upward extension formed of a linear actuator mounted within telescopic members. The telescopic members carry large wheels together with a linkage operated front wheels that are mounted on the forward position of the base. A power linear actuator assembly causes the telescopic members to extend and retract to move the wheelchair assembly from the mobile position to a raised position that permits the base to engage the floor surface and to assist the patient to move from a sitting position to a standing position.

21 Claims, 10 Drawing Sheets

(56) References Cited

U.S. PATENT DOCUMENTS

| | | | | |
|---|---|---|---|---|
| 7,097,189 | B2 | 8/2006 | Hsu | |
| 7,165,778 | B2 | 1/2007 | Kuiken | |
| 7,398,989 | B2 | 7/2008 | Laffin | |
| 7,419,176 | B2 | 9/2008 | Perk | |
| 7,887,133 | B2 | 2/2011 | Perk | |
| 8,556,347 | B2 | 10/2013 | Lin | |
| 8,662,595 | B2 | 3/2014 | Kramer et al. | |
| 8,844,961 | B2 | 9/2014 | Hunziker | |
| 9,044,369 | B2 * | 6/2015 | Goldish | A61G 5/1051 |
| 9,050,232 | B2 | 6/2015 | Jeyasurya | |
| 9,101,520 | B2 | 8/2015 | Goldish et al. | |
| 9,173,792 | B2 | 11/2015 | Goffer | |
| 9,333,132 | B2 | 5/2016 | Bruestle | |
| 9,375,372 | B2 | 6/2016 | Hunziker | |
| 9,761,109 | B2 | 9/2017 | Ribble et al. | |
| 2007/0046081 | A1 * | 3/2007 | Shook | B62J 1/08 297/195.1 |
| 2013/0020779 | A1 * | 1/2013 | Green | A61G 5/125 280/200 |

* cited by examiner

SIT-TO-STAND WHEELCHAIR

This is a non-provisional U.S. Patent Application which claims the benefit of Provisional Application No. 62/707,595 entitled SIT-TO-STAND WHEELCHAIR filed Nov. 9, 2017, the entirety of which is incorporated in this application as if fully set forth herein.

BACKGROUND OF THE INVENTION

Field of Invention. This application is directed to a mobile device for persons with limited ambulatory ability. Such patients present mobility and ambulatory problems to themselves, to hospital and clinic technicians and to the personnel of senior living and assisted care facilities. Such problems include difficulty of moving from a bed to a mobile wheelchair and then to an imaging center where they must stand or position themselves on a table for an X-ray, computed tomography scan (CT scan) or a magnetic resonance image (MRI). Similarly, in senior living facilities and assisted living facilities, patients must often be moved from beds to shower facilities and to food service facilities.

These mobility problems are very trying to the patient. In addition, they impose substantial costs upon care providers in that additional personnel must be engaged to assist such patients to meet their mobility requirements. Too, such mobility problems also impose extra time costs in facilitating such movement.

Description of Related Art. These mobility problems have been previously recognized. Indeed, there have been numerous efforts to provide an acceptable, commercial solution to these problems. In general, those efforts have included a wheelchair for mobility combined with a power lift to assist the patient to move from a sitting position in the wheel chair to a standing position. However, such prior devices are illustrated by expensive, complex systems that often included a plurality of linkages, cables, pulleys, etc. An example of such systems is disclosed in U.S. Pat. No. 7,165,778 which issued on Jan. 23, 2007 on an application of Todd A. Kuiken. That effort to combine a sit-to-stand feature with a wheel chair feature required a plurality of linkages, anti-tip wheels, and a manually operated ratchet drive which manipulates tubes, a pulley and a cable system on each side of the wheel chair.

Another effort to design a wheel chair having a sit-to-stand function is disclosed in U.S. Pat. No. 5,772,226 which issued to Bobichon on Jun. 30, 1998. Again, this effort comprises a substantial number of linkages with an actuator that pivots the seat counterclockwise to assist the patient to move from a sitting to a standing position.

Such efforts to provide a wheelchair with a sit to stand capability also includes a separate lift system which can be combined with a standard wheelchair. This separate lift system requires a "universal attachment mechanism" that is adapted to attach to the frame of the wheel chair to raise and lower the wheelchair between an elevated position assisting the patient to stand and a mobile position. This prior patent is U.S. Pat. No. 9,333,132 which issued to Katezlift of Mendota Minn. on May 10, 2016.

On belief, none of the prior art developments have resulted in a commercially acceptable mobile wheelchair with a sit-to-stand capability. Those developments appear to lack the desirable low cost, as well as the simplicity, strength and/or reliability to be commercially acceptable. In sum and substance, the development of an acceptable, commercial sit-to-stand wheelchair has been a recognized long felt need.

SUMMARY OF INVENTIONS OF THIS APPLICATION

Contrary to the prior art, the present inventions avoid the use of plurality of linkages and pivot points moving through various angles to elevate the patient to a standing position. Instead, the present inventions comprise a low cost, high strength sit-to-stand wheel chair assembly. Their simplicity, strength and low cost is, in part, based on a telescopic power actuator that, of itself, comprises the wheelchair frame so as to avoid the duplication of both a separate frame and a separate power actuator. Moreover, this simplicity, strength and low cost structure includes a simple, low cost operative movement with a power actuator that is, preferably, encapsulated within the telescopic members.

Simplicity and low cost is further achieved by mounting and/or linking the wheels to the upper telescopic member so as to move the wheelchair from a retracted mobile position in which the wheels support the patient to an extended position in which the wheels are elevated and then to a solid base is positioned on the surface or ground to move the patient to a standing position with solid support and with confidence.

To achieve this structure and its unique functional capability, the present inventions are designed to provide one or more of the following advantages and characteristics:

1) a simple design in which an integrated actuator system moves the chair from a wheel supporting position to a fixed, floor supporting position when it is desired to assist the patient to move from a mobile, sitting position to a standing position;

2) a simple low cost design using tubular members to provide substantial strength and rigidity to the unit;

3) a simple low cost design using extendable, telescopic, tubular members integrated with a linear actuator to raise and lower the person from a wheel chair sitting position to an elevated sit-to-stand position;

4) a design using guided telescopic members to eliminate the undesirable lateral movement that results from a plurality of pivot points and interconnecting linkages upon elevating a patient;

5) a sit-to-stand wheelchair that eliminates the need for wheel brakes, and provides solid floor surface support for the base of the chair when elevating a patient to a standing position;

6) a sit-to-stand wheel chair that raises the patient to a standing position and simultaneously lowers the entire assembly to a supporting floor to provide a rigid, sturdy foundation to provide patient confidence with the certainty of movement;

7) a sit-to-stand wheelchair in which power is supplied in the form of a power linear actuator, preferably positioned within the telescopic members;

8) a sit-to-stand wheelchair in which the front wheels of the wheelchair are are moved to and from a mobile position by the power actuator that also controls vertical movement of the chair; and 9) an integral, unified mobile lift wheelchair having a low cost, high strength design with a minimum number of parts.

DESCRIPTION OF THE DRAWINGS

The manner in which the foregoing objectives and characteristics are attained is disclosed in the following specification and drawings in which.

DETAIL DESCRIPTION

Figure 1:
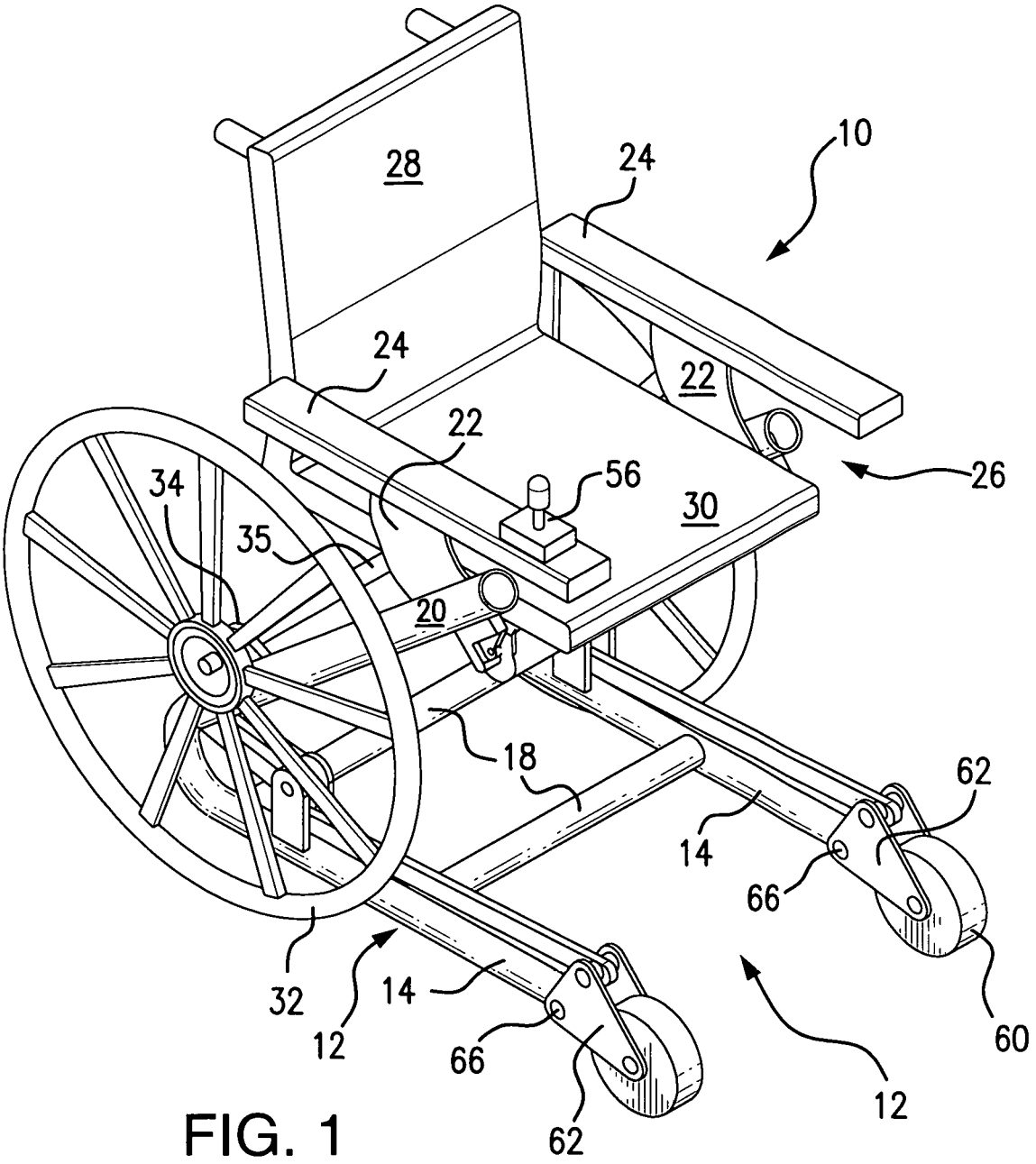
FIG. 1 is a perspective view of a preferred embodiment of the invention.

The preferred embodiments of my wheel chair inventions are shown in the drawings identified above. To illustrate the various alternative design variations of the present invention and the numerous modifications that may exists, three different wheelchair species are illustrated in the drawings. Each design incorporates telescopic or relative extendable-retractable members to move the chair from a mobile position to a stationary position in which the patient is elevated to a standing position. In the mobile position, the wheelchair has the normal functions expected of a wheelchair. In the elevated position, the patient is moved vertically upward or forwardly and upward to further assist his/her exit from the chair and subsequent movement to a standing position.

A first design is depicted in FIGS. 1-6. To achieve the strongest, lowest cost unit with the fewest components, and minimum undesirable movement, these preferred embodiments preferably utilize telescoping tubular or relatively slidable stock in which one member is extended and retracted relative to another member. In this species, a base 12 of the chair 10 comprises spaced apart elongated tubular members 14. Preferably, to provide greater strength and reduce cost, a tube bending machine, rather than welding, is used to bend the rear section of elongated members 14 at an acute angle to form an upward and forward extending sections 16 (see FIG. 3). Elongated members 14 and the extended telescoping members 16 are joined together by cross members 18 to define the rigid base 12 to support a wheel chair seat 26 which is mounted on upper tubular telescopic tubular members 20. These members 20 are preferably placed over the extending sections 16 to move a seat 26 upwardly and forwardly upon extension.

The wheel chair seat 26 is fixedly mounted upon the two upper telescopic members 20 through seat plates 22 affixed thereto. Preferably, the seat 26 has a seat back 28 and a seat bottom 30. The seat bottom 30, is preferably, a one piece unit, which is, in itself, more than adequate to enable a person to move from a sitting position to a standing position. However, an alternative is a two piece design for the seat bottom 30 such as that disclosed in a U.S. Pat. No. 8,973,997, filed as Application Ser. No. 13/185,855, the entire contents of which are incorporated herein as if they were also contained herein. Another alternative would be to provide for limited pivotal movement of the seat bottom 30 to further assist the person to move from the sitting position to the standing position.

Figure 2:
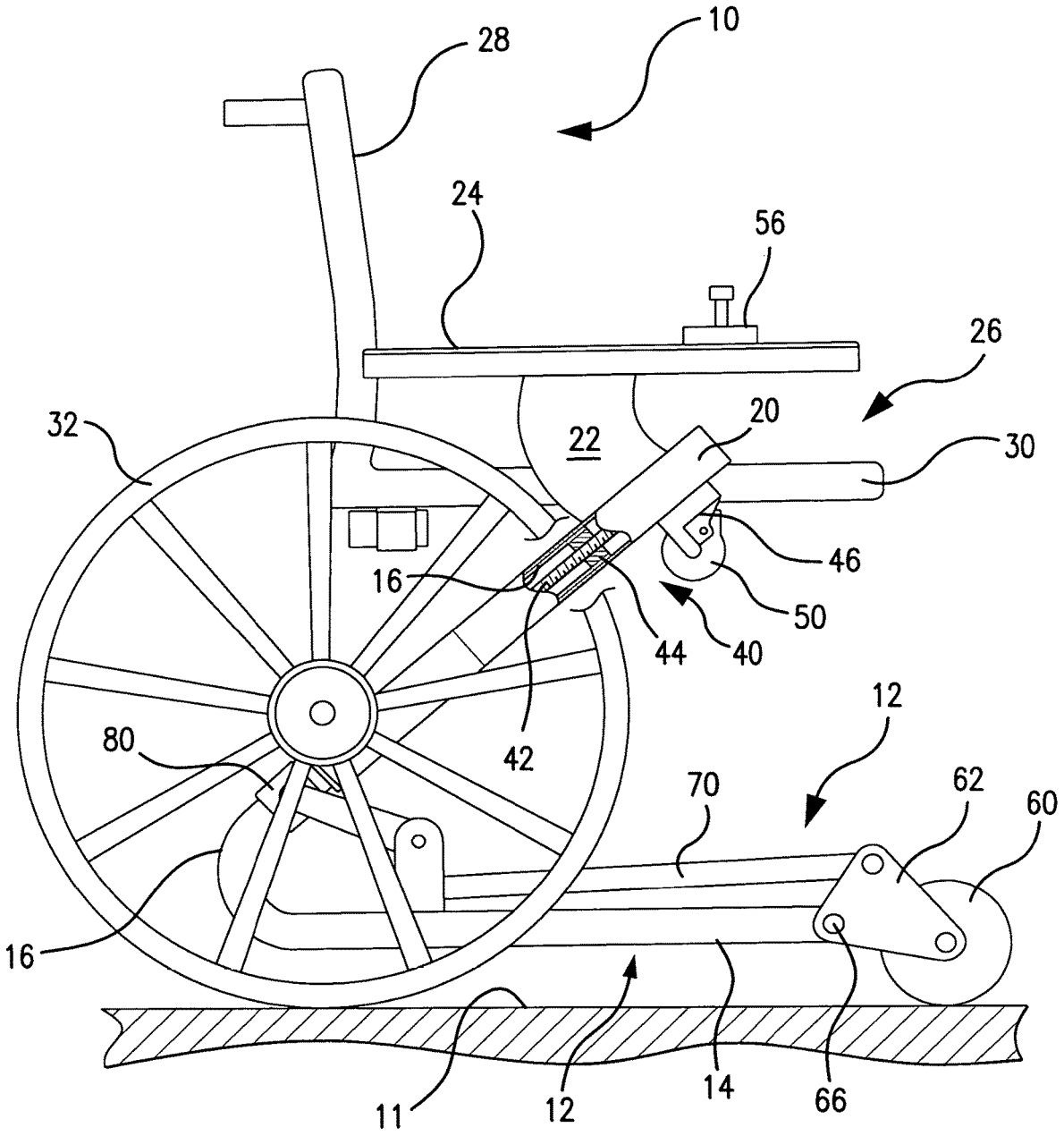
FIG. 2 is a side elevational view of the embodiment of FIG. 1 in which the wheel chair is in a mobile position with the telescopic members retracted.
Figure 3:
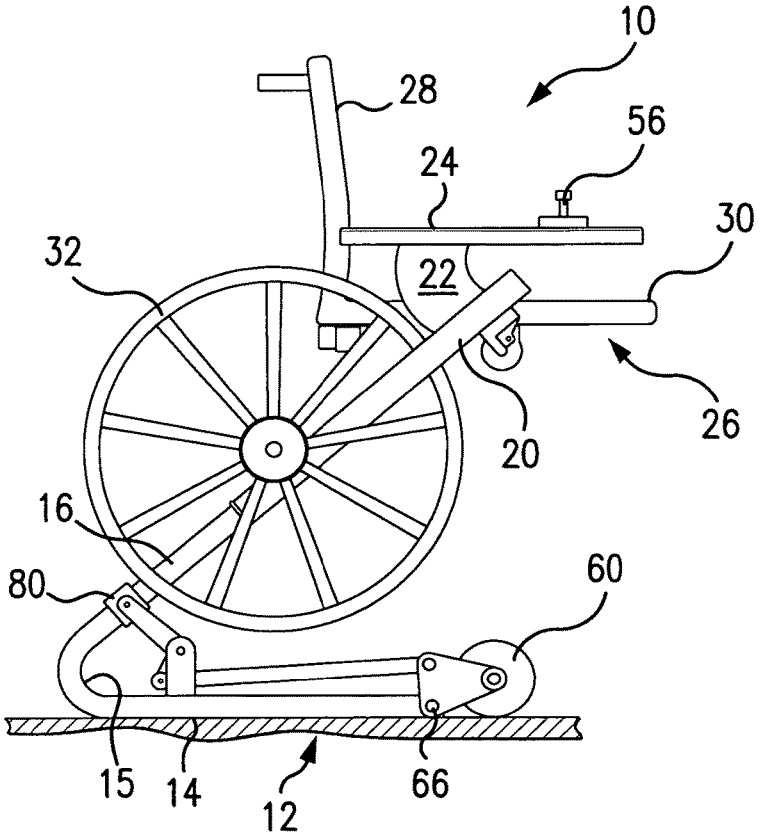
FIG. 3 is a side elevational view of the embodiment of FIG. 1 in which the wheel chair is in a stable position with its base engaging the floor and the telescopic members are extended to elevate the patient to a standing position.

FIGS. 1 and 2 illustrate the wheelchair in a mobile position in which large rear wheels 32 and front wheels 60 support the wheelchair on surface 11 for movement in a normal wheelchair operation. FIG. 3 illustrates the wheelchair in a fixed, immovable position with the wheels 32 and 60 elevated so that the wheelchair is rigidly supported on the ground surface 11 by the frame members 14 and the seat 30 is raised to permit the patient to move to a standing position.

The wheelchair can be converted from the mobile position of FIGS. 1 and 2 to the solid, stable position of FIG. 3 by elevating the wheels 32 and 60 and lowering the frame members 14. This elevation movement of the wheels is effectuated, preferably, by a linear actuator such as an electrically powered screw actuator assembly 40 which is further depicted in the broken away portions of FIG. 2. Such assemblies are commercially available from severable sources. One source is Smith Richards, Inc., 10786 Plaza Drive, Whitmore Lake, Mich. 48189. Preferably, such drives are 12 volt, DC drives with an approximate stroke of some 9 inches.

As shown in the embodiment of FIG. 2, this assembly 40 has a threaded screw shaft 42 that, preferably, is mounted inside each of the upper telescopic members 20 and extends downwardly to engage threaded actuator nut 44 that is fixedly mounted in the top of the tubular extension 16. Rotation of the screw shaft 42 will raise or lower the seat 26 dependent upon the direction of rotation.

Figure 6:
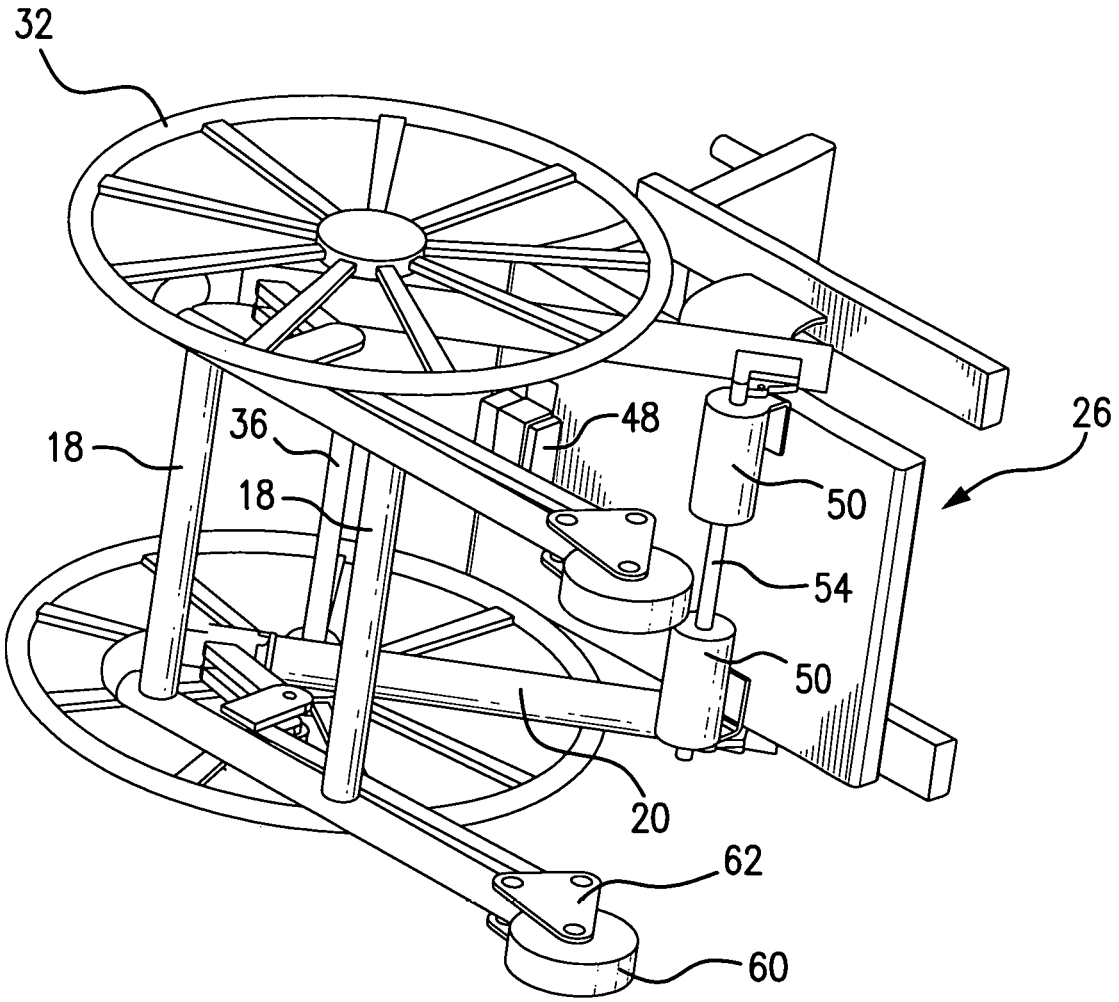
FIG. 6 is a perspective view of the bottom of the seat to better disclose the motor arrangement that drives the screw actuators within the telescopic tubular members.

Clockwise or counterclockwise rotation of the shaft 42 is caused by prepackaged gear drives 46 mounted on the underneath side of the seat with a battery package 48 (see FIG. 6). These gear drives 46 are actuated by dual motors 50 which may be interconnected by a common drive shaft 54 for synchronization. A switch 56 mounted on the arm rests is connected by an electronic circuit (not shown) to control operation of the motors 50. If desired, the circuits may include sensors and limit switches to control the positioning of the chair 10, such sensors and limit switches being well known in the art.

Also mounted on the upper telescopic members 20 are large wheels 32 which have an axle 35 passing through a bracket 34 which is mounted on extension 20. (See FIG. 1). Thus, as the screw actuator assembly 40 moves the upper telescopic member down, the main wheels 32 engage the surface 11 and elevate the chair to provide a mobile wheelchair. When the screw actuator assembly 40 raises the upper telescopic members, the wheels 32 are raised and the base 12 of the chair 10 with its elongated members 14 are lowered to engage the surface 11 for solid support. Simultaneously, the chair 10 is elevated to enable the patient to move from a sitting position to a standing position.

Persons skilled in the art will appreciate that different types of linear actuators can be used, including, for example, hydraulic actuators and/or hydraulic cylinders with electric fluid pumps.

In addition to moving the main wheels 32 up and down, the unit is provided with front wheels 60 which are also raised and lowered with respect to base 12 upon actuation of the linear actuator assembly 40. These wheels may fixed for straight travel or alternatively, they may comprise casters, balls or other wheels that permit rotational movement in any direction.

Figure 4:
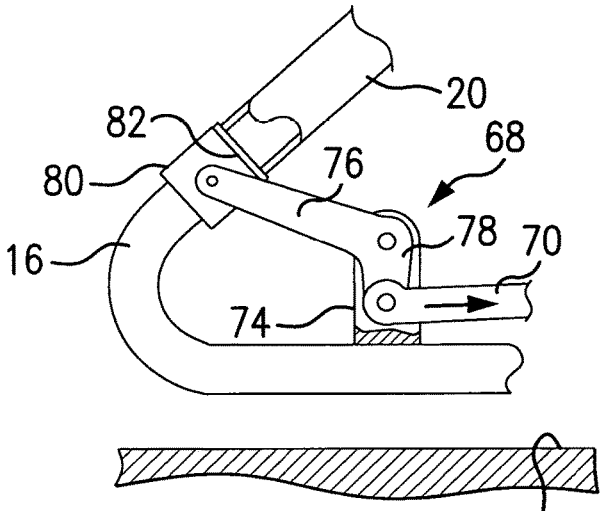
FIG. 4 is an enlarged view of the telescopic members in a retracted position to illustrate a bellcrank that pivots to force the front wheels downward into a ground engaging position to provide mobility to the unit, portions of the pivotal support being broken away.
Figure 5:
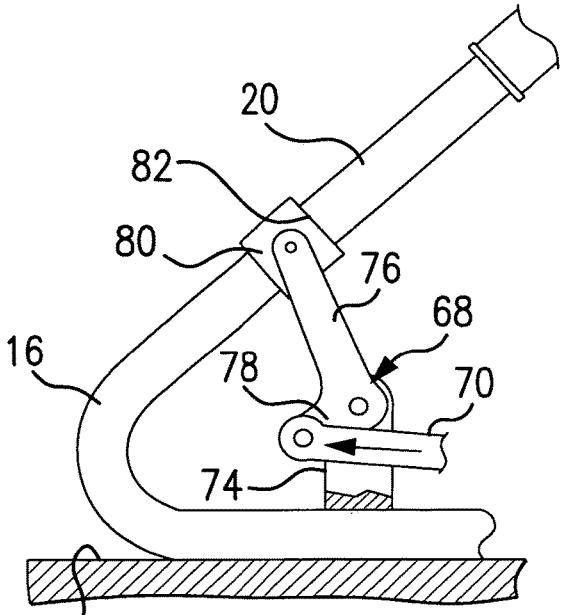
FIG. 5 is an enlarged view of the telescopic members in an extended position in which the chair base has been lowered to the ground surface and the chair seat has been elevated to assist the patient in moving to a standing position.

Considering the front wheel embodiment of FIGS. 1-5, the front wheels 60 have brackets 62 that are rotated by a link 70 and the bellcrank assembly 68 (see FIGS. 4 and 5). This assembly 68 includes a first link 76 which is connected to an abutting collar 80 that surrounds lower tubular member 16. This collar 80 has an abutting surface 82 that is engaged by upper tubular member 20 to drive it downward to rotate the bellcrank assembly 68 in a counterclockwise direction. As the assembly 68 is rotated counterclockwise, the link 78 of the assembly is rotated about pivot point 69 to urge link 70 forward or to the right as shown in FIG. 4. This forward movement of link 70 causes rotation of wheel bracket 62 about its pivot point 66 to move the wheels into engagement with the surface 11 and to raise the front portion of base 12 and supports 14 off the surface 11.

This rotation of the front wheels 60 to engage the surface 11 occurs simultaneously with the rear (main) wheels 32 engaging the surface 11. (As is common practice with patent drawings, these drawings, including the bellcrank and the remaining drawings are not to scale, and the dimensions and extent of movement will vary depending upon the size of the wheels, the height to which the wheel chair is raised, etc).

Alternatively, and as shown in FIG. 5, extension of the upper telescope member 20 by the linear actuator 40 removes the downward force on collar 80 and permits the bellcrank assembly 68 to rotate clockwise. This clockwise movement cause the link 70 to move to the left as shown in FIG. 5 to withdraw any downward force on the front wheels 60, thus permitting the base 12 to reside on the surface 11 in a stable position and simultaneously enable the seat to rise whereby the patient is elevated to a standing position.

Figure 7:
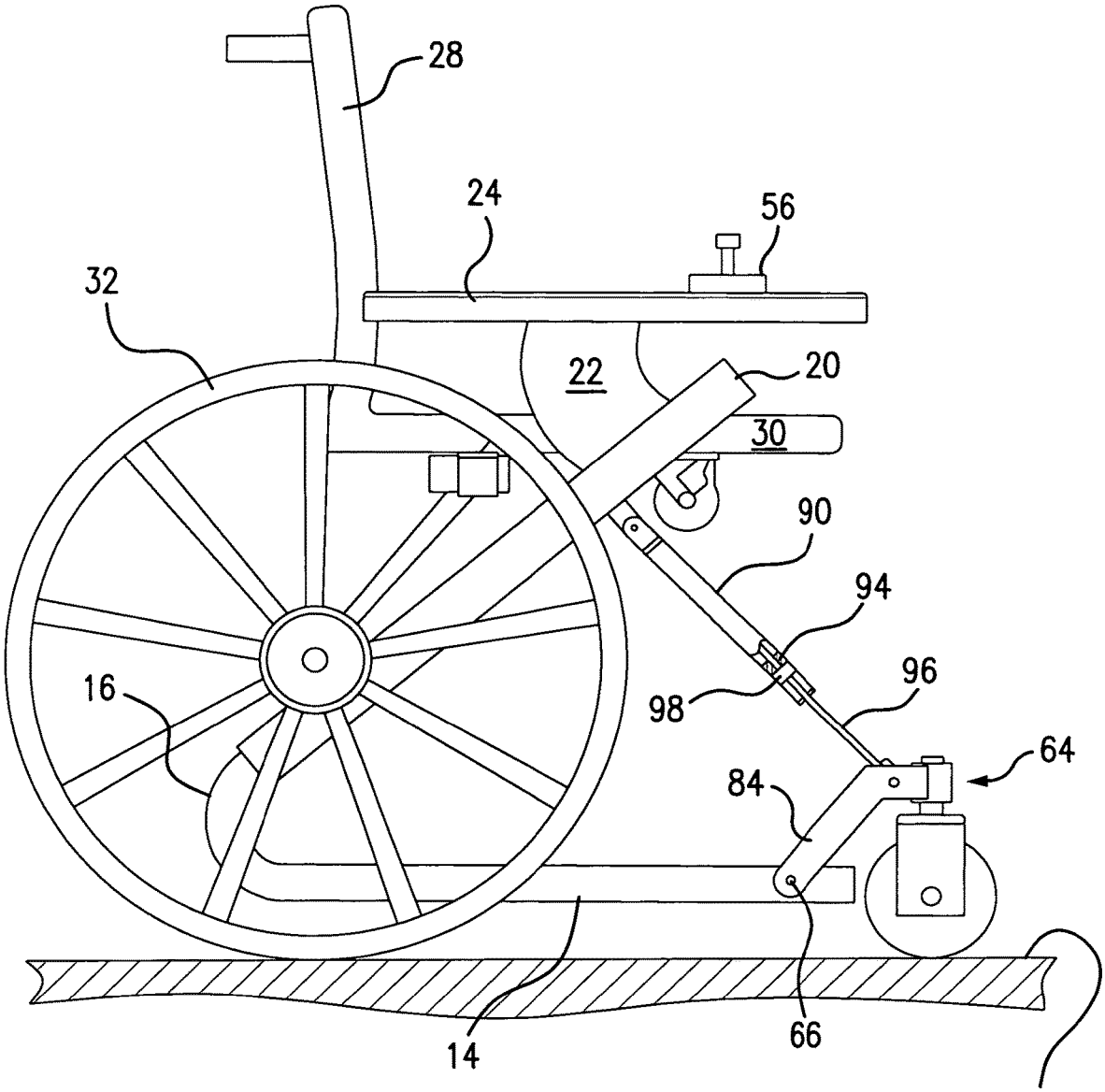
FIG. 7 is a side elevational view of an alternative, preferred embodiment of the invention in which the front caster wheels of the wheelchair have been forced down into a mobile, ground engaging position.
Figure 8:
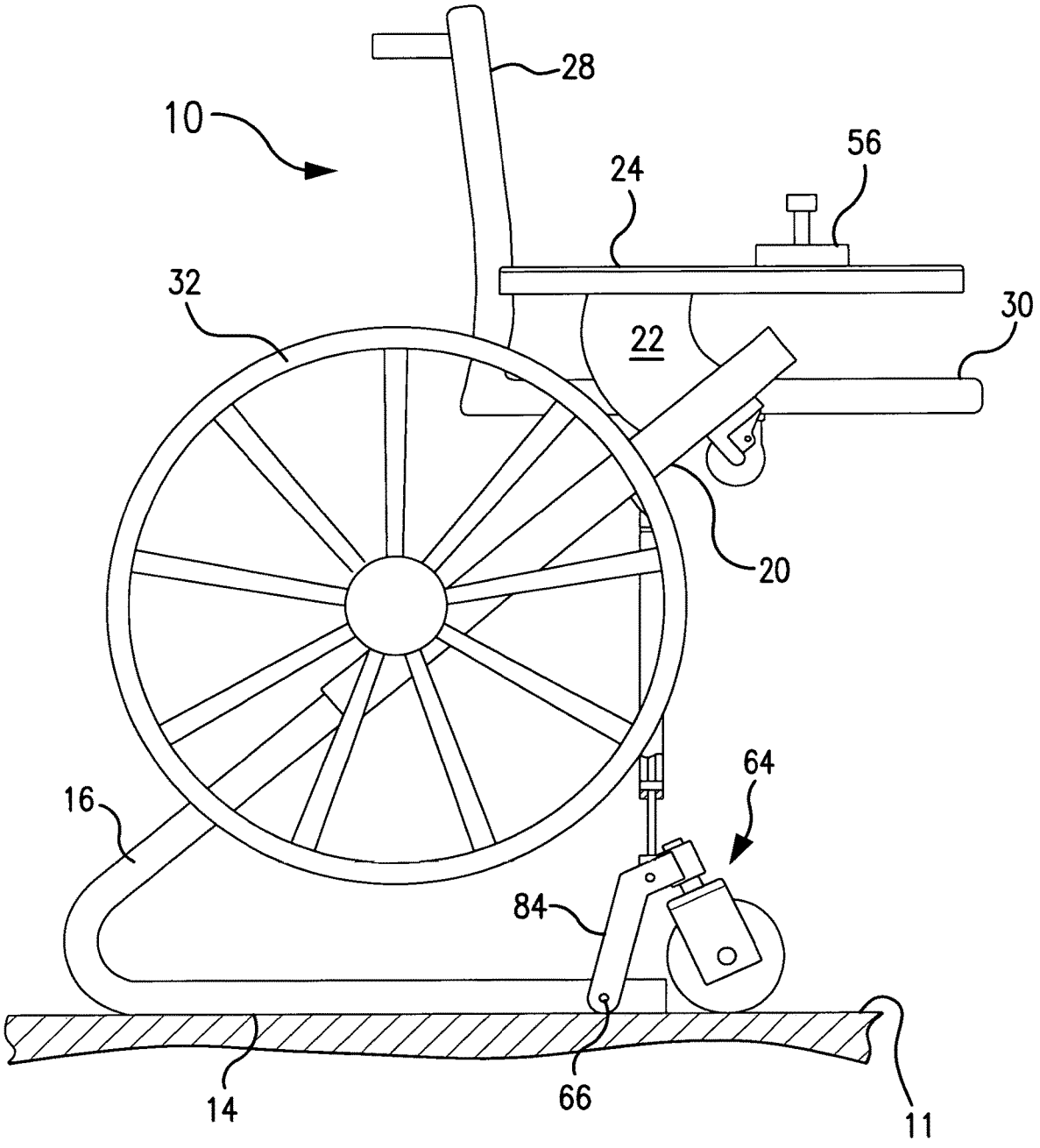
FIG. 8 is a side elevational view of the embodiment of FIG. 7 in which the front and rear wheels of the wheelchair have been elevated with the seat raised to to assist the patient to move to a standing position.
Figure 10:
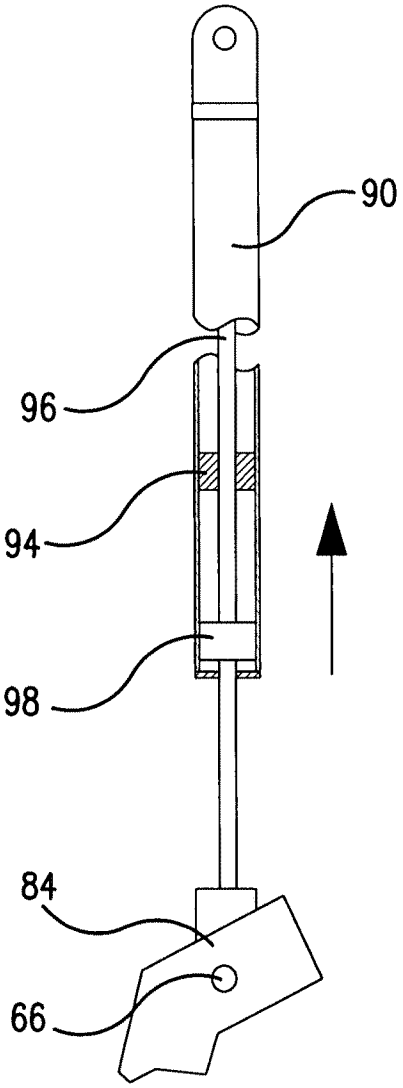
FIG. 10 is an enlarged view, with portions broken away, of the linkage of FIGS. 7 and 8 in which the linkage permits the front wheels to move upward to allow the base of the chair to be rigidly supported on the floor.
Figure 9:
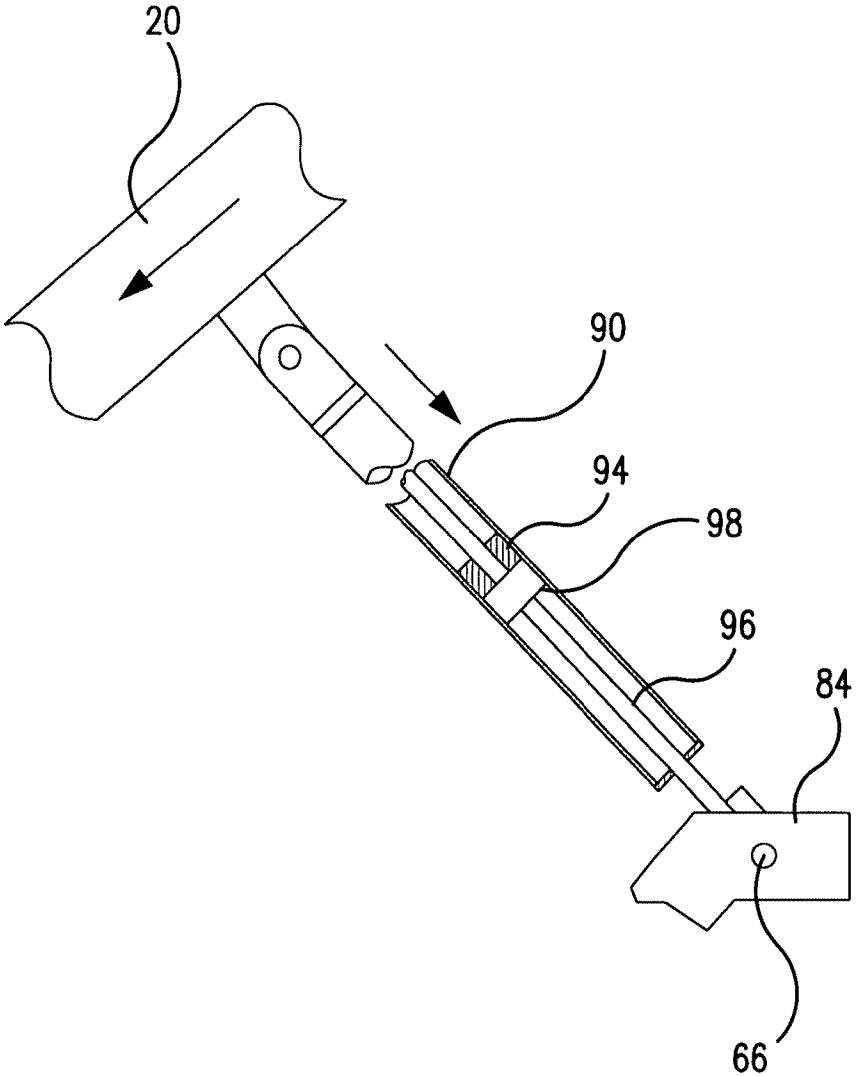
FIG. 9 is an enlarged view, with portions broken away of the linkage of FIGS. 7 and 8, the linkage being in a downward position to force the front casters into supporting engagement on the floor.

A second embodiment of the front wheel system is the caster system 64 shown in FIGS. 7-10. Here, the caster unit 64 has a linkage 84 pivotally connected to the elongated members 14 by a pivot pin 66. This pivotal linkage 84 is also connected by a rod 96 which extends upward within a cylinder 90 that is pivotally connected to upper telescopic member 20. As this upper telescopic member 20 is retracted downward, the cylinder 90 is pushed downward as shown in FIGS. 7 and 9. A plug welded abutment 94 within the cylinder 90 slides over the rod 96 to engage a donut 98 welded or fixed on the rod 96 to force link 84 clockwise and the caster unit 64 downward raising the front base 12 of the wheel chair 10 to make it mobile. Reverse movement of the screw actuator 40 raises upper telescopic member 20 which draws the cylinder 90 upward to permit the caster unit 64 to rotate counterclockwise and lower the wheel chair 10 to the floor to solidly support the chair as the patient is elevated to a standing position.

Figure 11:
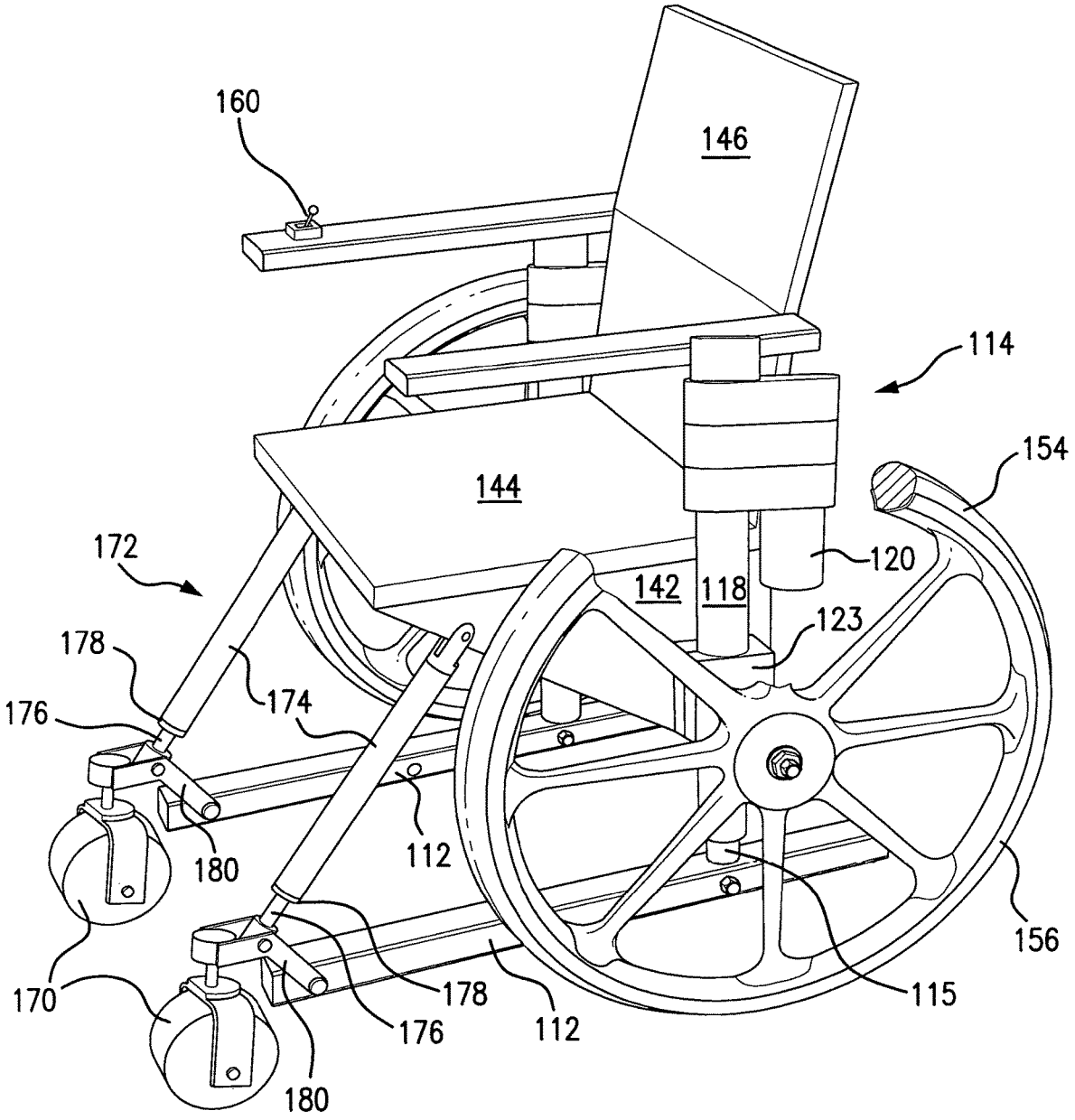
FIG. 11 is a perspective view of another alternative design in which the wheelchair is in a mobile position with the front and rear wheels engaging the ground surface and the base is raised to permit mobility of the wheelchair.
Figure 12:
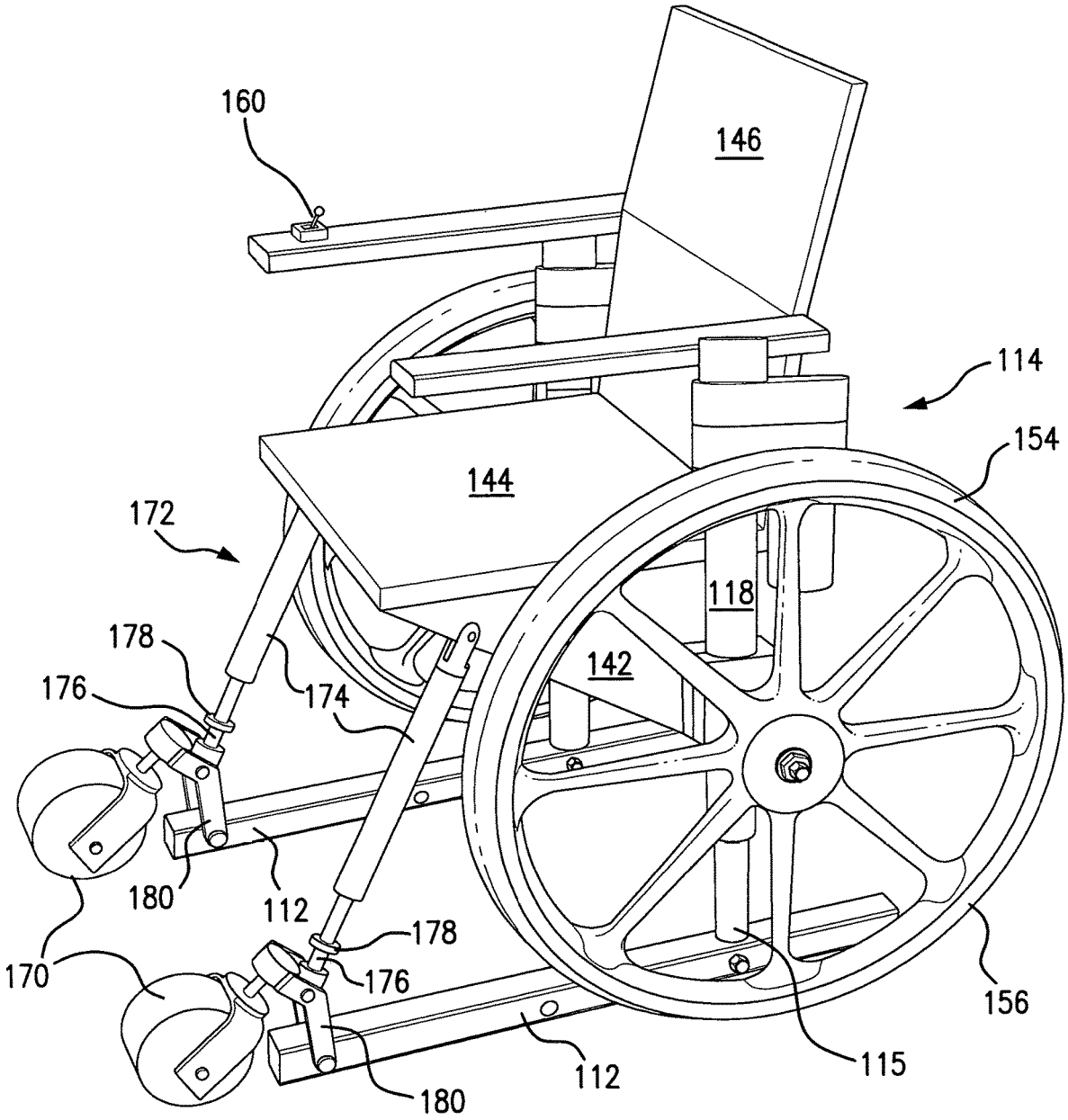
FIG. 12 is a perspective view of FIG. 11 which the wheelchair is in an elevated position to enable the patient to stand with the base of the unit resting on the floor surface and the wheels are elevated to a non-mobile position.
Figure 13:
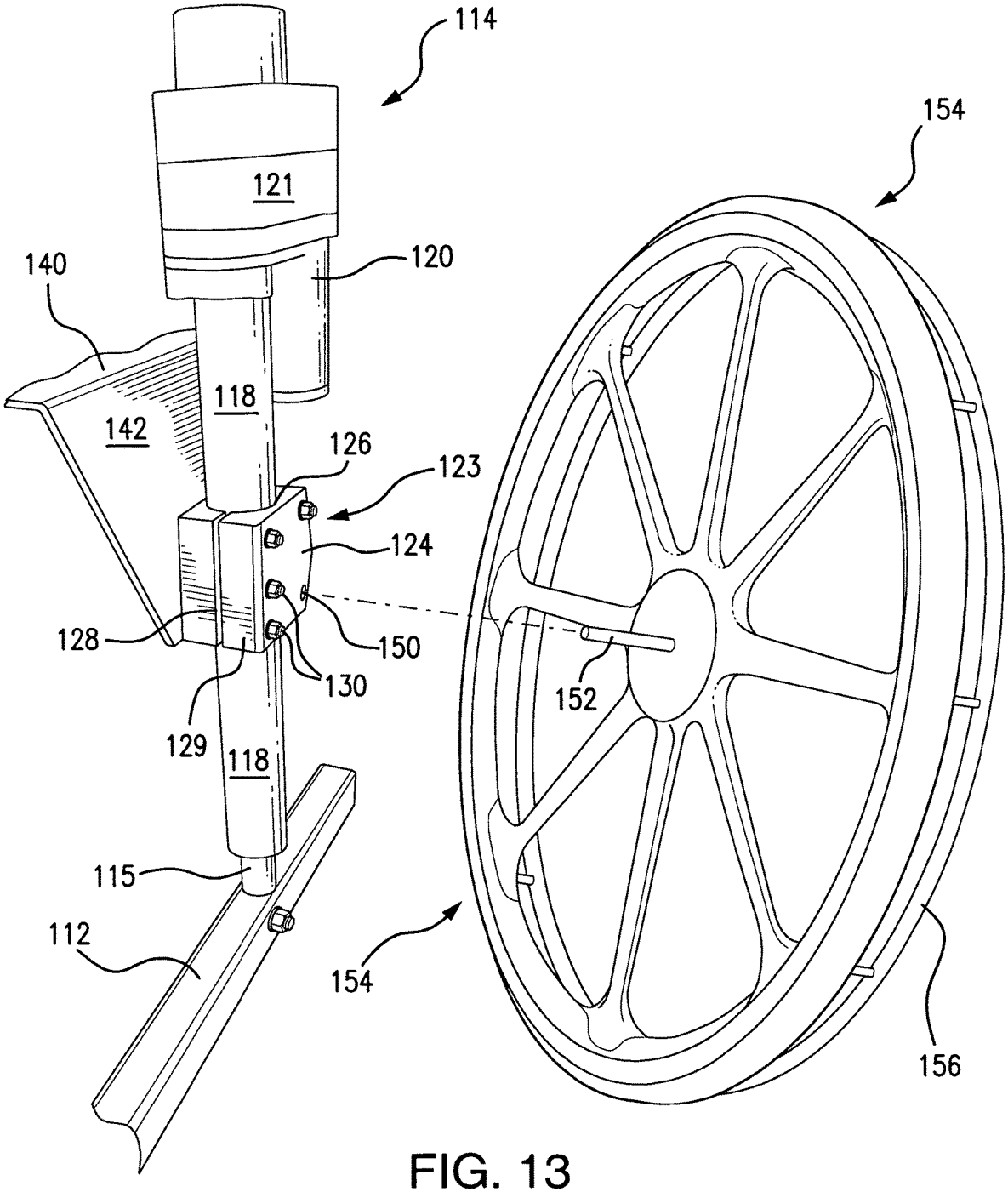
FIG. 13 is a perspective, exploded view depicting the interconnection or clamp between the wheels and the upper telescopic link of the actuator.

A third embodiment of these inventions is reflected in FIGS. 11 through 13. FIG. 11 illustrates two horizontal base supports 112 with a telescopic linear actuator 114 vertically mounted on each support 112 in a manner sufficiently rigid to support the wheelchair and a person. As shown in FIG. 13, the extendable linear actuator 114 comprises a lower tubular section 115 and an upper tubular section 118 driven, preferably, by a 12 volt DC motor 120 through a gear assembly 121 mounted just above the motor 120. Such DC operated linear actuators are commercially available and sources include, for example, those provided by JWF Technologies of Fairfield, Ohio or Saco-USA Inc. of Rockford Ill. sold under the name "Linear Actuator 808". This purchased actuator of FIGS. 11-13 provides vertical movement of some 350 mm or approximately 13 inches and includes rigid aluminum tubular members 115 and 118. Persons skilled in the art will appreciate that such tubular members may be separately manufactured of either plastic or metal and formed to accept a purchased linear actuator.

As best illustrated in FIG. 13, the upper tubular section 118 is clamped or gripped by a clamp assembly 123 which includes a clamp or bracket 124 with an aperture or bore 126 extending therethrough to receive the upper tubular section 118. Preferably, the clamp assembly 123 is a low cost unitary member although it could be formed of a plurality of clamping devices. In its unitary concept, the clamp 126 has a slit or cleft 128 extending from the aperture 126 to the front surface 129 of the claim. Bolts 130 extend through the clamp 126 to effect a clamping action on the upper section 118 of the telescopic member 114.

The clamp assembly 123 may include the seat bracket or plate 140 attached to the clamp 126 by its depending flanges 142. This bracket 140 carries a seat bottom 144 having a seat back 146. In addition, the clamp 124 is also provided with an aperture 150 for receiving the axle 152 of the rear wheels 154 of the wheelchair which may include a manual push ring 156.

As those skilled in the art will appreciate, the clamp assembly combination 123, comprising the clamp 124, the seat 144 and its bracket 140 together with the wheels 154, provides a very desirable, strong, low cost operating assembly. For example, operation of the linear actuator 114 in one direction will cause the telescopic member 118 to move vertically upward, carrying with it the seat 144, a person (not disclosed), and the wheels 154. This vertical upward movement of some 10-15 inches (depending on the actuator selected) will assist the ambulatory person to move to a standing position while minimizing the muscular effort to raise his/her own weight. And, significantly, as the clamp assembly 123 moves the wheels 154 and the person upward, the base members 112 are lowered to the surface to provide a very stable support for the wheelchair and to provide confidence of stability to the ambulatory person.

Alternatively, downward telescopic movement of the linear actuator 114 results in engagement of the rear wheels 154 to provide mobility to the wheelchair person. However, such mobility also requires engagement of the front caster wheels 170 with the surface. These front casters 179 are also actuated by a telescopic linkages 172 similar to those of FIGS. 9 and 10. Each linkage 172 comprises, preferably, three elements, i.e. and upper cylinder 174, a lower link or rod 176 which extends into the cylinder 174 and an abutment ring or lock 178.

In operation, as the linear actuator 114 is lowered, the clamp assembly 123 lowers the seat 144 and causes the main wheels 154 to engage the surface. This lowering movement of the seat 144 also causes the upper cylinder 174 for the front caster wheels 170 to engage the abutment ring or lock 178 that is welded or affixed to the lower link 176 which, in turn, causes the linkage 180 to move the casters 170 into engagement with the surface to provide four wheel mobility to the wheelchair.

As noted earlier, expansion or upper telescopic movement of the linear actuator 114 raises the seat 114 and the rear wheels 154 some 10-15 inches and simultaneously lower the base supports 112 to the surface. This upper telescopic movement also removes the force exerted on the casters 170 by pulling the upper cylinders 172 away from the abutment 178 thereby permitting the base members 112 to engage the surface for stability of the wheelchair.

Persons skilled in the art will also appreciate that numerous choices can be made regarding wheel sizes, tubular sizes, the extend of movement of the upper telescopic members etc. For this reason, and consistent with the Patent Office rules, the drawings presented herein are not to scale. In addition to changes in sizes, various alternative types of actuators may be used, including hydraulic as well as manual. Significantly, those skilled in the art will appreciate that using the linear actuator as the frame will support various modifications and alternatives. As an example, the frame might be mounted on an axle that is provided with a brake in order to provide a stationary platform for using the actuator to raise the person to the standing position. Too, person skilled in art will appreciate the modification of the linkages and the abutment surfaces may be readily changed without departing from the scope of the inventions presented herein. Additionally, foot rest plates may be added to make the wheelchair more comfortable. The electronic circuit for actuation of the linear actuators may vary depending on numerous safety features such as sensors to limit the height of the movement of the actuators, control boxes that are chosen etc.

I claim:

1. An integral, sit-to-stand wheelchair for a person in need of mobility, said wheelchair adapted to be engaged in a fixed condition on a surface so as to enable a seated person to safely and confidently move from a sitting position to a standing position or, alternatively, to be engaged in a mobile condition in which wheels are positioned on said surface to enable the wheelchair and the person to be wheeled from location to location, said sit-to-stand wheelchair comprising:

a) an elongated base for engaging a surface in said fixed condition, said elongated base having wheels pivotably mounted on one end thereof to permit said elongated base to engage said surface; and b) a power actuated member having upper and lower telescopic sections, said lower telescopic section being affixed to said elongated base and said upper telescopic section extending therefrom for reciprocal movement upward and downward, said upper telescopic section carrying a clamp-seat assembly; said clamp-seat assembly comprising:

i) a seat for supporting a person;

ii) an axle with wheels for engaging said surface; and iii) a link interconnected to said pivotably mounted wheels whereby on upward movement of said upper telescopic section, said elongated base is lowered and said clamp-seat assembly is elevated to assist said person to move to a standing position or alternatively, upon downward movement of said upper telescopic section, said elongated base is elevated and said wheels engage said surface to provide mobility for said person and said wheelchair.

2. A wheelchair as recited in claim 1 in which said power actuated member comprises a linear screw actuator.

3. A wheelchair as recited in claim 1 in which said upper telescopic section is tubular and said clamp-seat assembly is mounted on said upper telescopic section for general upward and downward movement.

4. A wheelchair as recited in claim 1 in which said clamp-seat assembly comprises a clamp formed of aluminum with an aperture therethrough for receiving and clamping said upper telescopic section.

5. A wheelchair as recited in claim 1 in which said elongated base comprises two spaced apart base members and a power actuated member extends from each of said spaced apart base members.

6. A wheelchair as recited in claim 5 in which said clamp-seat assembly is affixed to said upper telescopic section.

7. A sit-to-stand wheelchair for persons in need of mobility, said wheelchair having a fixed condition on a surface so as to enable a seated person to safely and confidently move from a sitting position to a standing position and a mobile condition in which wheels are positioned on said surface to enable the wheelchair and the person to be wheeled from location to location, said sit-to-stand wheelchair comprising:

a) an elongated base formed of at least two spaced apart elongated base members for supporting said wheelchair on a surface in a fixed condition, each spaced apart elongated base member having surface engageable wheels affixed adjacent one end thereof, b) a telescopic member extending upwardly from the other ends of each said spaced apart elongated base member, said telescopic members having a seat for a person, wheels for mobility of said wheelchair and a control link for moving said surface engageable wheels into engagement with said surface; and c) said telescopic members providing said fixed condition for said wheelchair when said telescopic members are in an elevated position and said person desires to move to a standing position and for providing said mobile condition of said wheelchair when said telescopic members are in a retracted position.

8. A wheelchair as recited in claim 7 in which said telescopic members have an upper tubular section and a lower tubular section and a power actuator is incorporated in said upper and lower tubular sections.

9. A wheelchair as recited in claim 8 in which said tubular telescopic members extend and retract in a vertical and forward direction.

10. A wheelchair as recited in claim 8 in which said power actuator is a linear screw actuator.

11. A wheelchair as recited in claim 10 in which a clamp is carried by said upward extending telescopic member and said clamp supports said seat and said wheels.

12. A simple, low cost, sturdy wheelchair having a first stable condition for assisting a non-ambulatory person to move from a sitting position to a standing position and a second mobile condition for transporting said person, said wheelchair comprising:

a) an elongated support for stable engagement with a surface to provide said first stable condition said elongated support having pivotal wheels mounted thereon;

b) at least one upwardly extendable and retractable telescopic member affixed to said elongated support and carrying a seat, rotatable wheels, and a linkage to said pivotal wheels; and c) said at least one upwardly extendable and retractable telescopic member providing said first stable elevated position of said seat for assisting said person to move to a standing position while simultaneously lowering and providing engagement of said elongated support with a surface and providing a second position for mobile condition for a patient and said wheelchair upon extension and/or retraction of said telescopic member.

13. A wheelchair as recited in claim 12 in which said at least one upwardly extendable and retractable telescopic member is comprised of an upper and lower telescopic member and a clamp is carried by said upper telescopic member having fixed thereto i) a seat, ii) an axle with a rotatable wheel thereon; and iii) a linkage for said pivotable wheels.

14. A wheelchair as recited in claim 13 in which said clamp surrounds said at least one upwardly extendable and retractable telescopic member and is clamped thereto by bolts extending therethrough.

15. A wheelchair as recited in claim 12 in which said at least one upwardly extendable and retractable telescopic member includes a power actuator to upwardly extend and retract said seat, wheels and linkage between said first stable elevated position and a lower second mobile condition.

16. A wheelchair as recited in claim 15 in which said at least one upwardly extendable and retractable telescopic member is tubular and a power actuator is positioned within said telescopic member to vertically extend said telescopic member between said first stable elevated position and said lower second mobile position.

17. An integral, unified mobile lift chair for mobilizing an individual in a mobile sitting position or, alternatively, for assisting said individual to move from a sitting to a standing position said lift chair comprising:

a) a seat having an elongated base support for stably engaging a surface to enable said individual to move to a standing position and having a set of wheels for alternatively mobilizing said individual in a sitting position on said surface; and b) a linear actuator interconnected between said seat and said elongated base support for lowering said elongated base support into engagement with a surface to assist said individual to move to a standing position and for alternatively raising said elongated base support and engaging said set of wheels on said surface to mobilize said individual in a sitting position.

18. A mobile sit-to-stand wheelchair for moving a person from one location to another and for assisting said person to move from a sitting position to a standing position, said wheelchair comprising:

a) a base for engaging a stable surface to prevent movement of said wheelchair;

b) a frame formed of a telescopic linear actuator for vertical movement mounted upon said base; and c) a set of wheels and a seat connected to said linear actuator for mobile movement of said wheelchair when said linear actuator is retracted to engage the set of wheels with the stable surface and for assisting said person to stand when said linear actuator is extended to elevate the set of wheels and cause said base to engage said stable surface to prevent said movement of said wheelchair.

19. A mobile sit-to-stand wheelchair as recited in claim 18 in which:

a) said linear actuator is a screw actuator having an upper and lower telescopic member and said upper telescopic member carries said seat and wheels.

20. A mobile sit-to-stand wheelchair as recited in claim 18 in which said base comprises two spaced apart elongated members and said set of wheels and said seat are connected to a separate linear actuator mounted upon each elongated member.

21. A mobile sit-to-stand wheelchair as recited in claim 20 in which said seat and said wheels are clamped to said linear actuator for vertical movement.

* * * * *